United States Patent [19]

Siegenthaler

[11] 4,303,347

[45] Dec. 1, 1981

[54] MATRIX PRINTER CARRIAGE ARRANGEMENT

[75] Inventor: Fritz Siegenthaler, Trub, Switzerland

[73] Assignee: Autelca AG, Gümligen, Switzerland

[21] Appl. No.: 135,550

[22] Filed: Mar. 31, 1980

[30] Foreign Application Priority Data

Mar. 30, 1979 [CH] Switzerland ..... 2968/79

[51] Int. Cl.[3] ..... B41J 25/30; B41J 19/30

[52] U.S. Cl. ..... 400/354; 400/320; 400/328; 400/352

[58] Field of Search ..... 38/74; 308/6 R; 400/121, 124, 320, 322, 323, 328, 352, 354

[56] References Cited

U.S. PATENT DOCUMENTS

| | | | |
|---|---|---|---|
| 2,353,151 | 7/1944 | Elsenheimer | 38/74 X |
| 3,393,459 | 7/1968 | Lanahan et al. | 308/6 R X |
| 3,872,960 | 3/1975 | Gabor | 400/320 X |
| 3,951,249 | 4/1976 | Nerbas et al. | 400/328 X |
| 4,030,590 | 6/1977 | Wojdyla | 400/320 X |
| 4,049,108 | 9/1977 | Giessner | 400/124 |
| 4,116,568 | 9/1978 | Suzuki et al. | 400/328 X |
| 4,189,244 | 2/1980 | Harrison | 400/320 X |

*Primary Examiner*—Paul T. Sewell

*Attorney, Agent, or Firm*—Brady, O'Boyle & Gates

[57] ABSTRACT

The matrix head (1) of a matrix printer is guided close to the printing site (2) on a round bar (7) by means of profiled rollers (8) absorbing the reactive force during printing and being fixedly mounted at the matrix head (1) and by means of guide rollers (9) absorbing the force of gravity of the matrix head (1) and being resiliently mounted at this head, and is slidingly guided, at the head end facing away from the printing site (2), on a rail (15). A cord drive serves for displacing the matrix head (1), this cord drive comprising a cord (31, 32, 33, 34, 35) guided over a cord pulley (17) at the matrix head (1) and over further cord pulleys (19, 23, 24) and over a driving pulley (26), the ends (29, 30) of this cord being fixedly attached beside the ends of the round bar (7). Thereby the matrix printer can be constructed in a compact and lightweight fashion and can be operated with accuracy even in case of strong vibrations.

3 Claims, 4 Drawing Figures

MATRIX PRINTER CARRIAGE ARRANGEMENT

The matrix head [pin-studded head] of a matrix printer, which head is displaceable to and fro in the line direction along its guide means, must be shifted stepwise in a very accurate fashion. Positional errors must be negligibly small as compared with the diameter of a matrix imprint, which amounts, for example, to 0.2 mm.

In commercially available matrix printers, the matrix head of which is displaceable by means of a threaded spindle, the freedom of clearance necessary for the helical drive means to obtain the required accuracy cannot be attained without an appreciable frictional resistance; consequently, a strong, correspondingly large and heavy drive motor is needed. Besides, the helical drive means is sensitive to contamination of the threaded spindle.

In other matrix printers available commercially, the matrix head of which is guided on a guide rod by means of a guide sleeve and is attached to an endless cable extended over a cable pulley and a drive pulley, the sleeve guidance, if it is to be without play, is likewise sensitive to contamination, and an elongation or slippage of the cable results in a positional error of the matrix head, equal to the amount of elongation or slippage and affecting, in case of slippage, all subsequent printing operations. The latter is especially disadvantageous, if, in one printed line, the top halves of characters are printed and the lower halves of characters are printed in the subsequent printed line, and slippage occurs in one printed line, or both printed lines, or in between the two printed lines. Elongation and slippage can occur, for example, on account of friction in case of a contaminated matrix head guide, in case of accelerations produced by vibrations if the matrix printer is used in a vehicle, and by the accelerations or decelerations of the matrix head taking place during normal operation at the beginning and end of each line, especially if the matrix printer is to operate at great speed, for which purpose matrix printers are actually particularly suitable as a consequence of the printing principle involved.

The invention is based on the object of providing a matrix printer which is less sensitive to contaminations and vibrations and yet can be manufactured with relatively small dimensions and low weight.

One embodiment of the matrix printer of this invention is illustrated in the appended drawings with its parts essential in connection with the invention, in a simplified arrangement. In the drawings:

FIG. 1 shows a rear view of the matrix printer seen in the direction of arrow I in FIGS. 2 and 3, FIG. 2 is a section along line II—II in FIG. 1, FIG. 3 is a section along line III—III in FIG. 1, and FIG. 4 is a schematic illustration of the principle of the cord drive for the matrix printer of FIGS. 1–3.

DESCRIPTION OF THE PREFERRED EMBODIMENT

Figure 1:
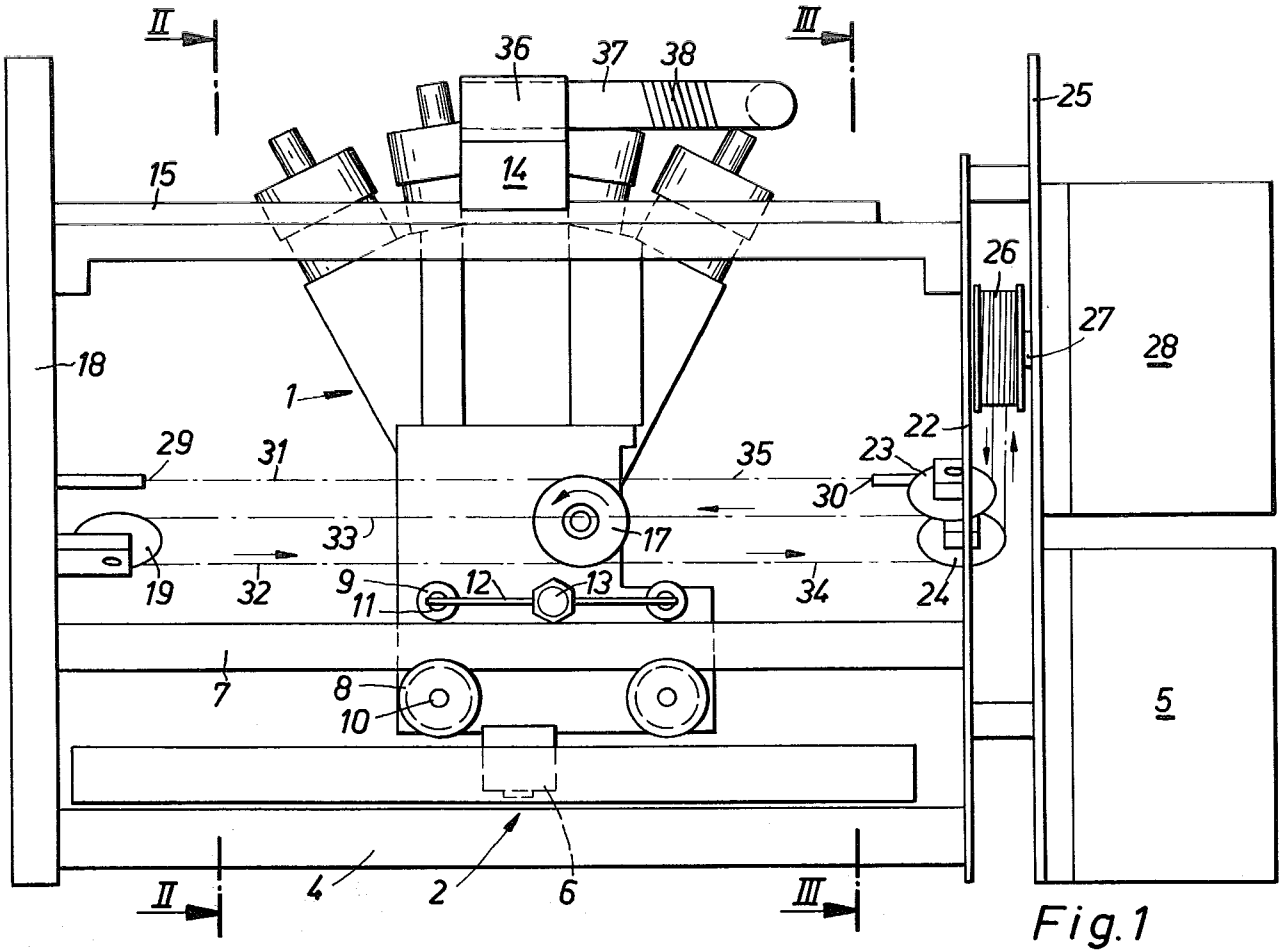

In FIG. 1, the matrix head 1 of the matrix printer is in a position corresponding approximately to the center of a line to be printed. The pins of the matrix head 1 produce an imprint at the printing site 2 on a paper by means of an inked ribbon, this paper having been fed through a feed slot 3 on a support 4. The paper, inked ribbon, ribbon guide means, and ribbon feed means, and a possible paper cutter are not illustrated. Only the drive motor 5 of the paper feed means is indicated in contour.

The working end 6 of the matrix head 1, facing the printing site 2 (which is the lower end in the drawing), is guided at a round bar 7 by means of two pairs of rollers 8 and 9. The rollers 8 are arranged on the side of the round bar 7 facing the printing site 2 and are rotatably supported on shafts 10 fixedly attached to the matrix head 1. These rollers have a peripheral groove of a V-shape in cross section and absorb, together with the round bar 7, the reactive force occurring during the printing process, unyieldingly supporting the matrix head 1 in the direction of this force.

The rollers 9 are rotatably supported on shafts 11, respectively in a bifurcated-slotted end of a pretensioned leaf spring 12, the center of this leaf spring being fixedly joined to the matrix head 1 by means of a bolt 13. The pretensioning of the leaf spring 12 is higher than the gravity of the matrix head 1 to ensure a secure guidance of the latter.

The matrix head 1 is guided at the (upper) end facing away from its (lower) working end 6 displaceably by means of a slide 14 along a guide rail 15, but secured against a rotation about the round bar 7. The slide 14 needs merely to slide along the rail laterally since the weight of the matrix head 1 is supported by the rollers 9. The rail 15 has a much larger spacing from the round bar 7 than the printing site 2, so that a sufficiently accurate positioning (perpendicularly to the plane of the drawing of FIG. 1) of the (lower) working end 6 of the matrix head 1 is attained with a minor play of the slide 14 on the rail 15, at which play the sliding friction of the slide is negligible and no troublesome effects can occur due to contamination.

In this way, the matrix head 1 is displaceably supported along its guide means 7, 15 practically without friction, and is also rigidly supported by means of the rollers 8 against the reactive force occurring during the printing step, so that the entire pressure force of the pins can be exploited.

Directly above the rollers 9, a twin-groove cord pulley 17 is rotatably mounted at the matrix head 1. On the sidewall 18 shown on the left-hand side in FIG. 1, a cord pulley 19 is supported, and cord pulleys 23 and 24 are mounted in recesses 20 and 21 of the right-hand partition 22, and between the partition 22 and the right-hand sidewall 25, a driving pulley 26 provided with a helical groove is arranged, this pulley 26 being seated on the shaft 27 of a stepping motor 28 carried by the wall 25. The arrangement of the cord pulleys 19, 23, and 24 results conventionally from the position of the twin-groove cord pulley 17 and the drive pulley 26 and the extension of the cord is described below.

One end 29 of an elongation-resistant (i.e. practically not stretchable) cord is attached to the sidewall 18, the other cord end 30 is attached to the partition 22. The cord extends from one end 29 in a first section 31 in parallel to the round bar 7 to the twin-groove cord pulley 17, loops around it in one of its grooves by 180°, travels in a second section 32 to the cord pulley 19, where it is again deflected by 180°, so that the subsequent, third section 33 again extends in parallel to the round bar 7. Thereafter the cord is deflected at the cord pulley 23 by about 90° toward the drive pulley 26 around which the cord is looped several times, following the helical groove, whereupon the cord is deflected by about 90° by the cord pulley 24 and extends, in a fourth section 34, again in parallel to the round bar 7 into the other groove of the twin-groove cord pulley 17, where it is looped around by 180°, whereupon the last, fifth section 35 follows, extending to the other cord end 30. The section 31 is in alignment with section 35, and section 32 is in alignment with section 34, except for a small parallel displacement caused by the spacing of the two grooves of the twin-groove cord pulley 17. As can be seen, the cord extends between the sections 31 and 32 about one peripheral half and between the sections 34 and 35 about the other peripheral half of the twin-groove cord pulley 17. Sections 31, 32, 34, and 35 must extend in parallel to the round bar 7 so that the tension of the cord remains constant while the matrix head 1 runs along the guide bar 7 and the guide rail 15 when printing a line. The point on the cord lying in the center of the length of the helical groove of the drive pulley 26 is fixedly determined to be the point lying in the center of the cord section wound onto this driven pulley 26 when the matrix head 1 is in the center of its path extending along the bar 7 and the rail 15. For this purpose, the cord is suitably guided through one of two mutually adjacent, radial bores of a hollow-cylindrical body of the drive pulley, this body exhibiting the helical groove on the outside; the cord is thus guided into the interior of this body and out of this body through the other bore. The cord section wound in the helical groove must be at least four times as long as the displacement path of the matrix head 1, since, for the whole displacement path on one side of the point where the cord is attached to the drive pulley 26, a cord section of respectively twice the length of this path must be wound up, and the same amount of cord must be unwound on the other side of this point.

Figure 4:
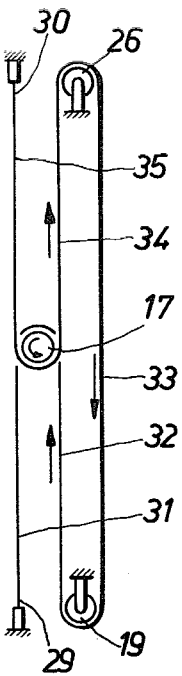

FIG. 4 shows the extension of the cord without the cord pulleys 23 and 24, which are unnecessary to effect the principle of the present cord drive arrangement but make it possible to arrange the drive motor 28 with the drive pulley 26 independently of the position of the cord pulley 17 and of the displacement direction of the matrix head 1, in a space-saving fashion.

Figure 3:
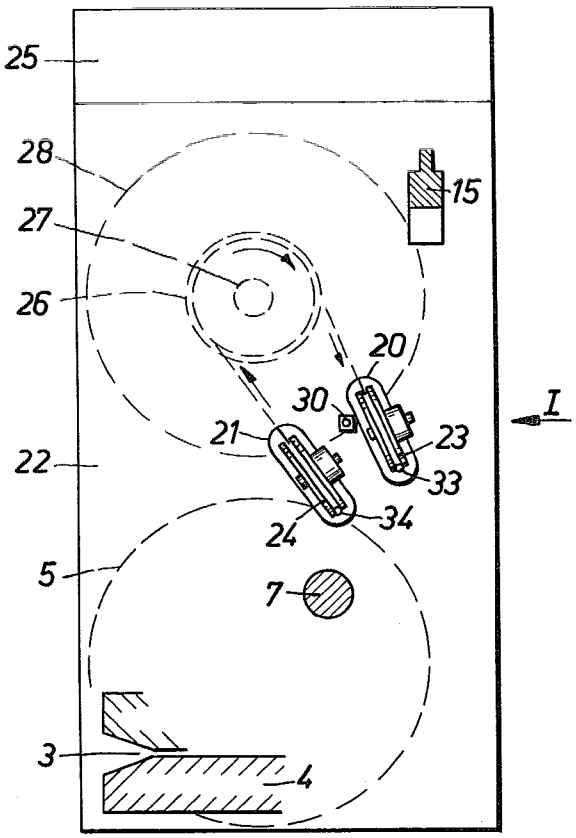
Figure 2:
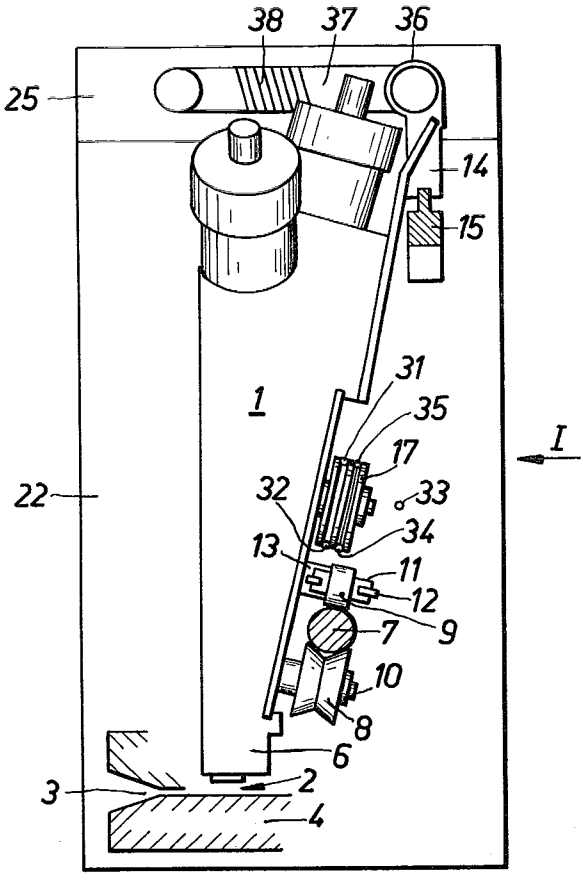

FIGS. 1, 3, and 4 show the travel directions of the twin-groove cord pulley 17 and of the drive pulley 26, as well as of the cord for the displacement of the matrix head 1 in FIG. 1 toward the right, indicated by arrows in solid lines. The opposite directions apply for a displacement of the matrix head 1 in FIG. 1 toward the left.

The above-described cord drive is, as such, free of play, has no appreciable friction, and is not trouble-prone, especially it is not sensitive to dust and other contaminants. The matrix head 1 is held directly at four cord sections 31, 32, 34, and 35 with respect to vibrations in the displacement direction. The tensile force effective on the drive pulley 26 in case of a vibration due to the mass inertia of the matrix head 1, the torque of which must be withstood by the motor, is only half as high as the force caused by the mass inertia of the matrix head 1. Since the ends 29 and 30 of the cord are fixedly held, the cord is fixed at the drive pulley 26, and the cord tension acts in opposed directions on the twin-groove cord pulley 17 at the matrix head 1, a slippage of the cord, which could have an effect on the position of the matrix head 1, is reliably prevented. The radii of the cord pulleys 17, 19, 23, 24, and also of the drive pulley 26 can be made to be relatively large in spite of a compact construction. This is important for the selection of the cord material, and for the life-time of the cord, as well as for a positioning of the matrix head 1 secure in the tension direction of the cord.

A sleeve 36 is formed at the upper end of the slide 14, this sleeve accommodating the end of the head connecting cable 37 joined to the matrix head 1. The other cable end is fixedly supported (not shown). This cable has a casing constituted by a helical spring 38 (shown only partially) and is arranged in the uppermost portion of the housing between the sidewalls 18 and 25 and the front and rear walls, not shown, in the top view (plan view), not illustrated, in a U-shape with its legs in parallel to the bar 7 and the rail 15 and is held elastically by means of the helical spring 38. This cable adapts, upon a displacement of the matrix head 1, to the respective position of the latter by lengthening one U-leg and correspondingly shortening the other U-leg. The cable can vibrate in case of shocks, but returns always to its position under the action of the spring 38.

Experiments carried out with a matrix printer constructed with the above-described guide arrangement and the aforementioned cord drive resulted in perfect printings with vibrations of up to 3 g acceleration.

The terms and expressions which have been employed herein are used as terms of description and not of limitation, and there is no intention, in the use of such terms and expressions, of excluding any equivalents of the features shown and described or portions thereof but it is recognized that various modifications are possible within the scope of the invention claimed.

What I claim is:

1. In a matrix printer having a matrix printing head (1) having a working end (6), a printing site (2) adjacent the working end (6), and guide means (7, 8, 9, 14, 15) connected to guide the matrix printing head (1) in parallel to the line direction close to the printing site (2); said guide means comprising:

rolling guide means (7, 8, 9) connected to guide the working end (6) of the matrix printing head (1) in parallel to the line direction, and sliding guide means (14,15) connected to guide the other end of the matrix printing head (1) in parallel to the line direction;

said rolling guide means including a stationary guide bar (7), and first (8) and second (9) guide rollers;

said first guide rollers (8) rotatable on axles (10) fixedly mounted to said matrix printing head (1) near the working end (6) thereof, said first guide rollers (8) having profiled edges engaging the side of said guide bar (7) facing the printing site (2);

spring means (12) connecting said second guide rollers (9) to said matrix printing head (1) and resiliently urging said second guide rollers (9) against the opposite side of said guide bar (7) by a force greater than the gravity weight of said matrix printing head (1);

said sliding guide means (14,15) including a stationary rail (15) connected parallel with said guide bar (7);

groove means (14) on the other end of said matrix printing head (1) from said working end (6); and tongue means on said rail (15) extending upwardly into sliding engagement in said groove means;

whereby said second guide rollers (9) supporting the matrix printing head (1) on the guide bar (7);

said first guide rollers (8) transmit to the guide bar (7) the reactive force during printing by the working end (6); and said rail (15) and said tongue and groove means (15,14) securing the matrix printing head (1) against rotation about said guide bar (7).

2. A matrix printer as defined in claim 1, in which said guide bar (7) has a circular cross section.

3. A matrix printer as defined in claim 1, in which said spring means (12) resiliently urging said second guide rollers (9) against the guide bar (7) comprises a leaf spring (12) attached at its longitudinal center to said matrix head (1), and said leaf spring having bifurcated ends supporting said second guide rollers (9).

* * * * *